US007789098B2

(12) United States Patent
Livacich et al.

(10) Patent No.: US 7,789,098 B2
(45) Date of Patent: Sep. 7, 2010

(54) HUNTING GROUND BLIND FOR RAPID CONCEALMENT

(75) Inventors: John Livacich, Sunnyvale, CA (US); Kendyl A. Roman, Sunnyvale, CA (US)

(73) Assignee: Eurio, Inc., Santa Clara, CA (US)

( * ) Notice: Subject to any disclaimer, the term of this patent is extended or adjusted under 35 U.S.C. 154(b) by 0 days.

(21) Appl. No.: 12/459,934

(22) Filed: Jul. 8, 2009

(65) Prior Publication Data

US 2009/0272414 A1 Nov. 5, 2009

Related U.S. Application Data

(63) Continuation-in-part of application No. 11/788,495, filed on Apr. 20, 2007.

(51) Int. Cl.
*E04H 15/54* (2006.01)
*E04H 15/36* (2006.01)
*E04H 15/48* (2006.01)

(52) U.S. Cl. ..... 135/115; 135/901; 135/135; 135/147

(58) Field of Classification Search ..... 135/901, 135/905, 906, 907, 98, 124, 136, 133, 135, 135/143, 147, 120.3, 120.4, 115
See application file for complete search history.

(56) References Cited

U.S. PATENT DOCUMENTS

| | | | | |
|---|---|---|---|---|
| 2,854,988 | A * | 10/1958 | Peddell | 52/2.21 |
| 4,202,363 | A * | 5/1980 | Watts et al. | 135/98 |
| 7,475,699 | B2 * | 1/2009 | Johnson et al. | 135/117 |
| 7,493,910 | B1 * | 2/2009 | Ransom | 135/117 |
| 2005/0224107 | A1 * | 10/2005 | Yang | 135/135 |

* cited by examiner

*Primary Examiner*—David Dunn
*Assistant Examiner*—Danielle Jackson

(57) ABSTRACT

An easy to use, simple, lightweight, compact, portable, quiet, quick setup, hunting ground blind. The hunting ground blind includes novel methods of tightening the skin on a cover to reduce movement and noise. Methods include using the full human body, from hands to feet, and its strongest muscle groups to rapidly set up the hunting ground blind with tighter skin. Methods for setting up a fast setup frame with the human body in a seated row position. Improved fast setup frames are comprised of novel simpler components such as plates with single anchor connections. The components are easier to make, less costly using less material, yet yielding stronger, more durable frames.

20 Claims, 11 Drawing Sheets

HUNTING GROUND BLIND FOR RAPID CONCEALMENT

CONTINUATION AND PRIORITY CLAIMS

This application is a continuation-in-part of application Ser. No. 11/788,495, filed Apr. 20, 2007, and claims priority based on co-pending applications Ser. Nos. 11/155,398, 11/295,305, and 11/788,495. Some of the subject matter of this application was also disclosed in Ser. No. 12/290,213.

U.S. patent application Ser. No. 11/788,495 is included herein by reference.

RELATED APPLICATIONS

The following summarizes related applications. The subheadings are internal docket numbers and are used for shorter reference to the related application or patent.

| | |
|---|---|
| Lightweight portable concealment means and methods | |
| Provisional Application Ser. #60/295,956 | Filing Date: Jun. 4, 2001 |
| Lightweight portable concealment means and methods | |
| patent application Ser. #10/161,986 | Filing Date: Jun. 4, 2002 |
| Publication Number 2002/0189660 | Publication Date: Dec. 19, 2002 |
| Now U.S. Pat. No. 7,100,626 | Issue Date: Sep. 5, 2006 |
| Universal lightweight portable concealment means and methods | |
| patent application Ser. #11/045,736 | Filing Date: Jan. 28, 2005 |
| Publication Number 2005/0183761 | Publication Date: Aug. 25, 2005 |
| Modular system for concealment and shelter | |
| patent application Ser. #11/155,398 | Filing Date: Jun. 16, 2005 |
| Publication Number 2006/0000499 | Publication Date: Jan. 5, 2006 |
| Modular system for concealment and shelter | |
| patent application Ser. #11/295,305 | Filing Date: Dec. 5, 2005 |
| Publication Number 2006/0283491 | Publication Date: Dec. 21, 2006 |
| Modular system including shaft segments having configuration and breakdown attachments | |
| patent application Ser. #11/484,106 | Filing Date: Jul. 10, 2006 |
| Publication Number 2006/0283492 | Publication Date: Dec. 21, 2006 |
| System for concealment and shelter with structure for rapid set up and tight skin | |
| patent application Ser. #11/788,495 | Filing Date: Apr. 20, 2007 |
| Publication Number 2008/0006317 | Publication Date: Jan. 10, 2008 |
| System for rapid concealment and shelter including angular frames and warfighter covers | |
| patent application Ser. # 12/290213 | Filing Date: Oct. 27, 2008 |
| Publication Number 2009/0065039 | Publication Date: Mar. 12, 2009 |

BACKGROUND

1. Field of the Invention

This invention relates to lightweight, portable, rapid setup, hunting ground blinds and methods.

2. Description of Prior Art

There is often a need to conceal oneself when hunting. Hunters often conceal themselves in various hunting ground blinds to avoid being detected by their prey.

In the past, quite complex, heavy structures have been built or constructed for concealment. Hunters have built permanent hunting blinds. Complex blind structures have been carried into the great outdoors.

The following ground blinds or tents are known in the art:

Hunter's Specialties' "Lightweight Portable Ground Blind"

Avery' "Avery Quick Carry Ground Blind"

U.S. Pat. No. 5,062,234, entitled "Portable Blind"

Double Bull "Matrix"

Cabela's "Lightning Set" and "Lightning Set 4-Season"

Black Stump's "Instant Tent"

There are also a number of very old patents relating to tents with hinged shafts, such as U.S. Pat. No. 1,502,898, Berg, filed Jan. 12, 1924, or umbrella tents, such as U.S. Pat. No. 1,649,219, Goldberg, filed Mar. 23, 1927. U.S. Pat. No. 74,933, Palmer, issued Feb. 25, 1868, disclosed an inverse umbrella-type frame deployed by a rope external to the enclosure. U.S. Pat. No. 3,794,054, Watts, issued Feb. 26, 1974, disclosed an inverse umbrella tent.

The use of such devices has several disadvantages such as being heavy, bulky, noisy, expensive, and complicated to assemble or use. The frames are relatively weak or fail to adequately tighten the skin. There is a need for a simple, lightweight, compact, portable, rapid setup, hunting ground blind.

Human Body Strength and Skin Tightening

In the field of lightweight, portable, outdoor hunting ground blinds, there is a long felt need to have skins extremely tight to avoid detectable movement and noise. Numerous blind designs have attempted to provide the desired skin tightness but have failed without using complex, heavy frames that require significant time and athleticism to set up. Those that are lightweight and fast, such as conventional umbrella designs, fail to put enough force into the frame to provide the desired result. Further, because many blind products have promised, but have failed to deliver, cover skins that remain substantially motionless in windy conditions encountered while hunting, consumers are skeptical. To be successful a product must also stay taut when shaken by potential buyers on the trade show floor or in dealers' show rooms.

The arm muscles (biceps and triceps) of the human body are relatively weak compared to other muscle groups such as the legs, abdomen, back, and shoulders. This is especially true when arms are extended away from the body above the shoulders as is required to deploy conventional umbrella type blinds. Such blinds are set up with the frame expanded in an upright position and the operator either a) pushing up from inside with one hand while pulling a pull cord or shaft down with the other hand, or b) pushing down from outside with one hand while pulling a pull cord up with the other hand while standing beside the structure. For example, see the art cited in U.S. Pat. No. 6,354,316, Chen. Neither of these conventional methods takes advantage of the strongest muscles groups in the body to provide the skin tightening force.

In a horizontal, seated row position, for example as used in Olympic rowing, all of the large muscle groups of the body, including legs, abdomen, back, shoulder, and arms, are used to apply the force through the body between the feet and the hands. A typical outdoorsman can apply up to about 75 pounds of force in the seated row position, with an average of about 40 pounds over the full stroke. A six-foot human body has up to about 45 inches of range of motion in the seated row position (and about up to 65 inches if the arms are extended beyond the head).

Work or energy is measured in foot-pounds. When an operator applies an average of 45 pounds of force over a distance of 3.5 feet (i.e. 42 inches) about 157 foot-pounds of energy is applied. About the same amount of energy could also be stored by applying 57 pounds of force over a distance of 2.75 feet (i.e. 33 inches).

Hunters often have a need to quickly set up a hunting ground blind.

What is needed is a method of setting up a blind where the full muscle strength of the human body from hands to feet can be used to quickly provide the skin tightening force to a lightweight, portable blind. Further, what is needed is a hunting ground blind that can be quickly deployed to provide concealment.

SUMMARY OF THE INVENTION

Accordingly, it is an objective of the present invention to provide an easy to use, simple, lightweight, compact, portable, quiet, rapid setup, hunting ground blind, which can additionally be rapidly set up using the large muscle groups of the full human body resulting in tight cover skin. The system includes novel frames, and novel covers, designed specially for hunting.

Objects and Advantages

Accordingly, beside the objects and advantages described above, and in the parent applications, some additional objects and advantages of the present invention are:

1. To provide an improved hunting ground blind.
2. To provide methods of tightening a skin of a hunting ground blind to reduce undesired motion.
3. To provide shoot-through (or blackout sections) that can be moved to cover openings in a hunting ground blind while maintaining skin tightness.
4. To provide a fully enclosed hunting ground blind that allows unobstructed line of sight in 360 degrees of a substantially horizontal plane.
5. To provide unobstructed vision or shooting lanes.
6. To provide improved components and means of construction with lower cost and longer reliability.
7. To provide methods and means of tightening the skin on the sides of a cover to reduce movement and flutter.
8. To provide a dockless plate system.
9. To provide a quick setup frame that is strong enough to deploy without requiring spreading straps.
10. To provide shaft plates that provide structure strength and stability during initial spreading and during final stasis, resulting in smooth set up and improved durability.

These and other features and advantages of the present invention will become apparent upon consideration of the following specification, claims, and drawings.

DRAWING FIGURES

In the drawings, closely related figures have the same number but different alphabetic suffixes.

REFERENCE NUMERALS IN DRAWINGS

| | |
|---|---|
| 106 | shaft |
| 400 | operator |
| 686 (a-d) | corner section |
| 927 | plate conduit |
| 943 | separation shaft |
| 944 | separation shaft tip |
| 945 | upper plate |
| 946 | lower plate |
| 947 | separation shaft stop |
| 948 (a-d) | plate anchor |
| 954 (a-d) | stretcher shaft |
| 958 | shaft plate |
| 1210 | top window fastener |
| 1212a | left window fastener |
| 1212b | right window fastener |
| 1512 (a-d) | half arch cover shaft |
| 1534 | fast setup frame |
| 1535 | pull handle |
| 1536 | pull cord |
| 1540 | cover |
| 1612 (a-b) | cover window |
| 1631 | cover cap |
| 1636 | door fastener |
| 1642 | shoot-through panel |
| 1646 | quiet cover |
| 1653 | corner pocket |
| 1672 | window roll |
| 1763 (a-d) | threaded axle |
| 1782 | end piece |
| 1790 | foot attaching means |
| 1912 | guyline |
| 1913 | guyline clip |
| 1922 | see-through panel |
| 2010 | skirt |
| 2050 | skirt door |

Special Definitions cord—a flexible, and possibly elastic, filament including but not limited to a fiber, thread, string, rope, twine, wire, cable, yarn, thong, tendon, or line.

shaft—a supporting member in construction including but not limited to any solid or hollow, round or rectangular bar, beam, pole, rod, spar, or tube composed of wood, plastic, metal, or composite material.

DESCRIPTION OF THE INVENTION

The present invention comprises an easy to use, simple, lightweight, compact, quick setup hunting ground blind and methods for construction and use. A method of the present invention allows for 360-degree concealment.

The present invention is also directed to various structures and methods for skin tightening for hunting ground blinds. Novel frame structures are used to stretch and thereby tighten the skin of a hunting ground blind. Various solutions to this problem are provided. Various prior attempts to provide lightweight portable blinds with cover skins that remain tight in blustery, hunting conditions have failed because the structure is too weak and/or the set up method does not allow a human operator to apply a sufficient force to the skin tightening mechanism. The present invention includes novel structures and methods that allow the large muscle groups of the full human body to apply a skin stretching force to set up a hunting ground blind with previously unrealized results.

Figure 1A:
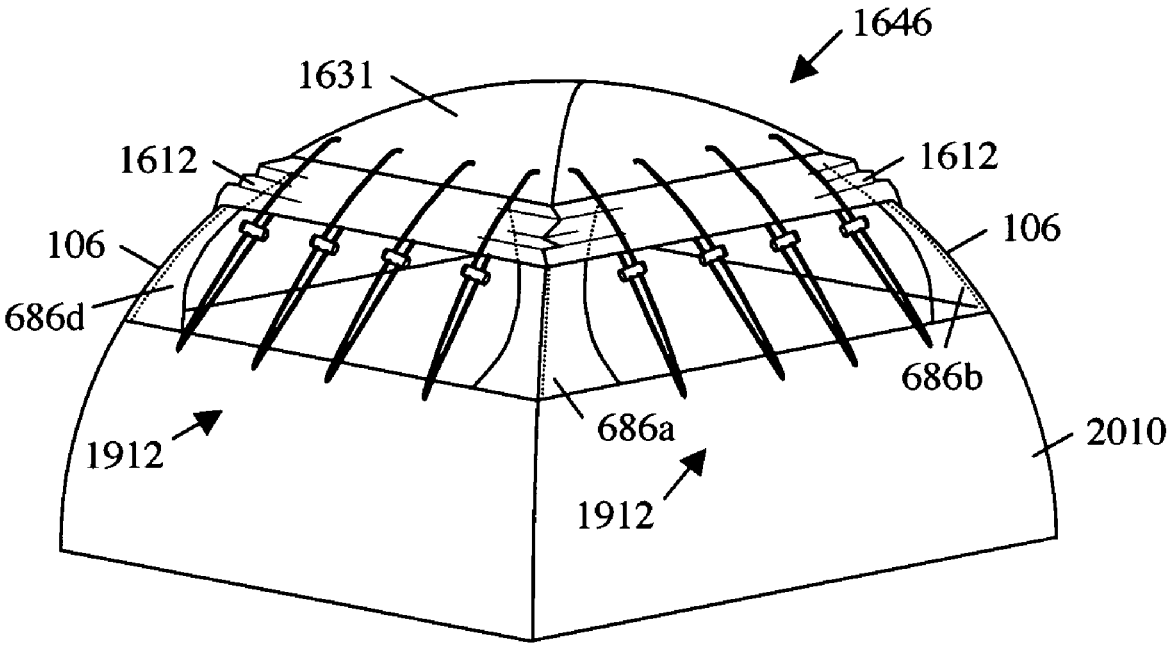
FIG. 1A through FIG. 1C show various embodiments and operation of hunting ground blind covers with guylines and adjustable windows.
Figure 1B:
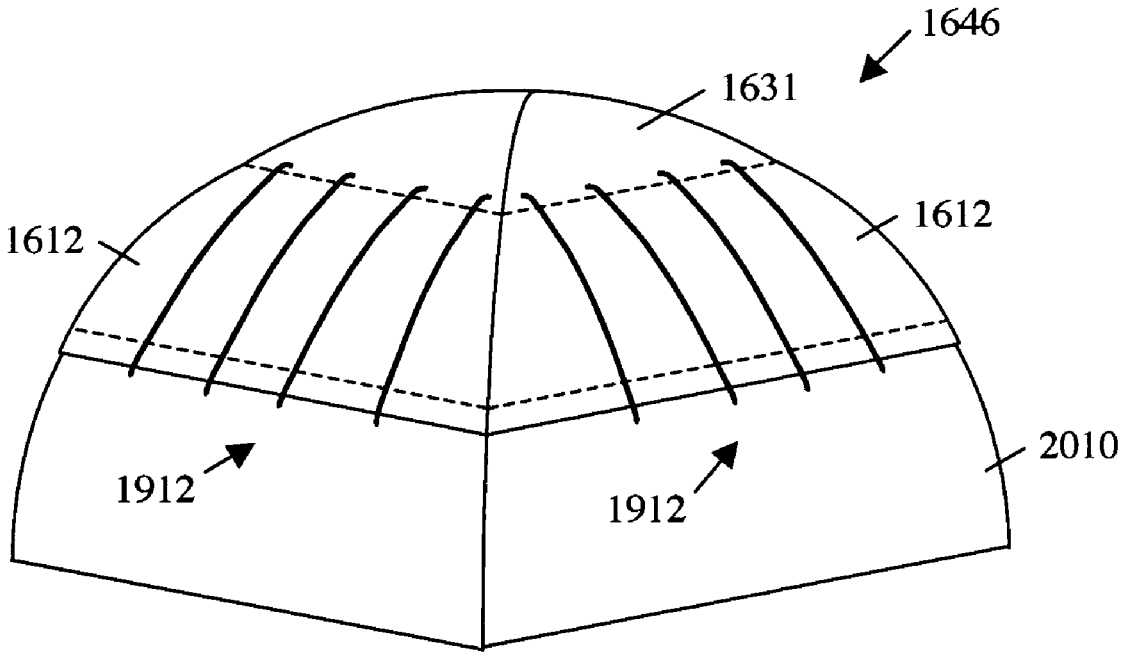
Figure 1C:
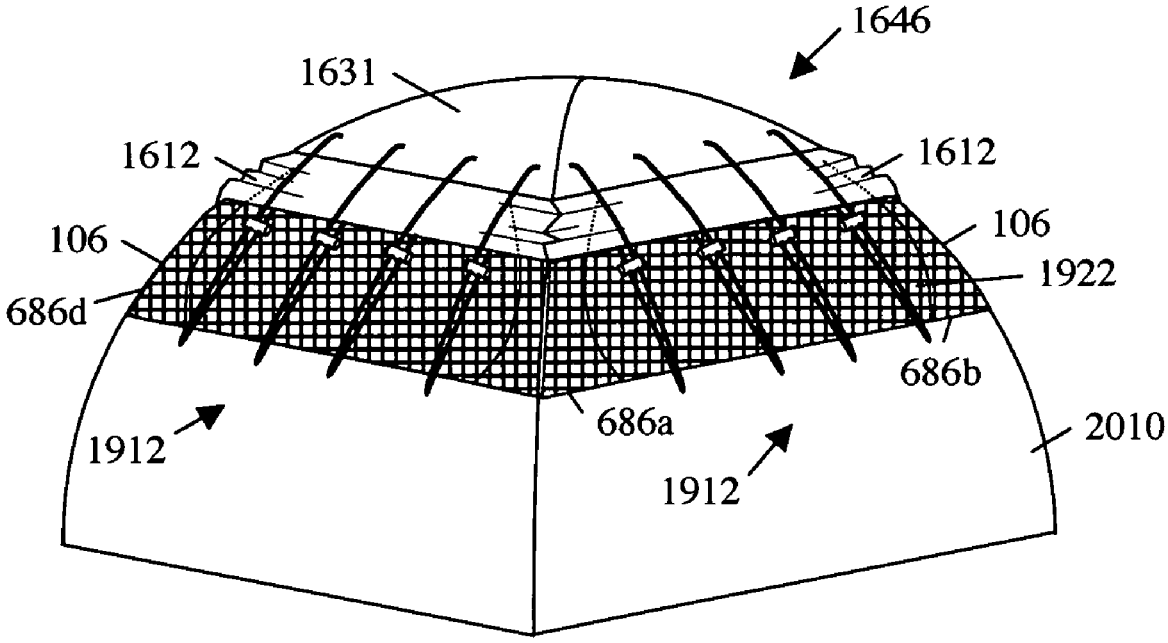

FIG. 1A Through FIG. 1C

FIG. 1A shows a quiet cover 1646 that embodies a novel three-tiered cover. The top tier comprises a cover cap 1631. The middle tier comprises a ring of windows 1612. The bottom tier is a skirt 2010.

The cover cap 1631 is connected to the skirt 2010 along the corners with corner sections 686 (*a-d*). The corner sections 686 provide for taut skin.

This embodiment also shows the novel use vertical guylines 1912. Unlike FIG. 6, where the cover windows 1612 are attached to the guylines 1912, in this embodiment the window 1612 material is sandwiched and held up between two sections of guylines 1912. A plurality of guylines are shown across the middle of each cover panel wall. Like the corner section 686 in the corners, the guylines 1912 connect the material of the cover cap 1631 to the material of skirt 2010, and thus help to maintain the skin tightening wall tension, even when one or more of the windows 1612 are open. The guylines 1912 also sandwich the material of the windows 1612 so that it does not flutter in the wind.

FIG. 1B shows the embodiment of FIG. 1A with each of the visible windows pulled down.

Figure 7:
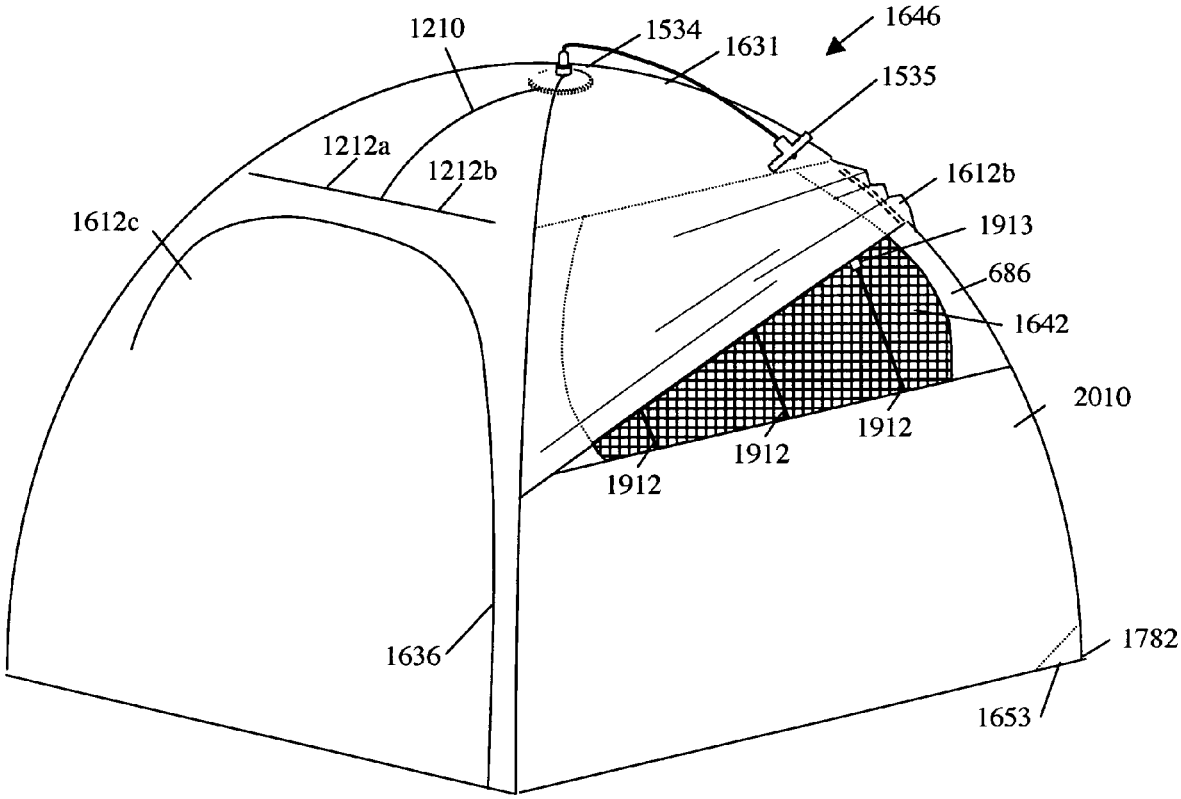
FIG. 7 shows yet another currently preferred embodiment of a hunting ground blind.

FIG. 1C shows an embodiment of a hunting ground blind further showing see-through panels 1922. See-through panels 1922 can also slide between the guylines 1912 or alternatively can be fixed shoot-through panels 1642 (as shown in FIG. 7) attached to the outside or inside of each respective wall. The wall tension is maintained the guylines 1912. Maintaining tension on the shoot-through panel 1642 also reduces the interference with the flight of an arrow, for example.

Figure 2A:
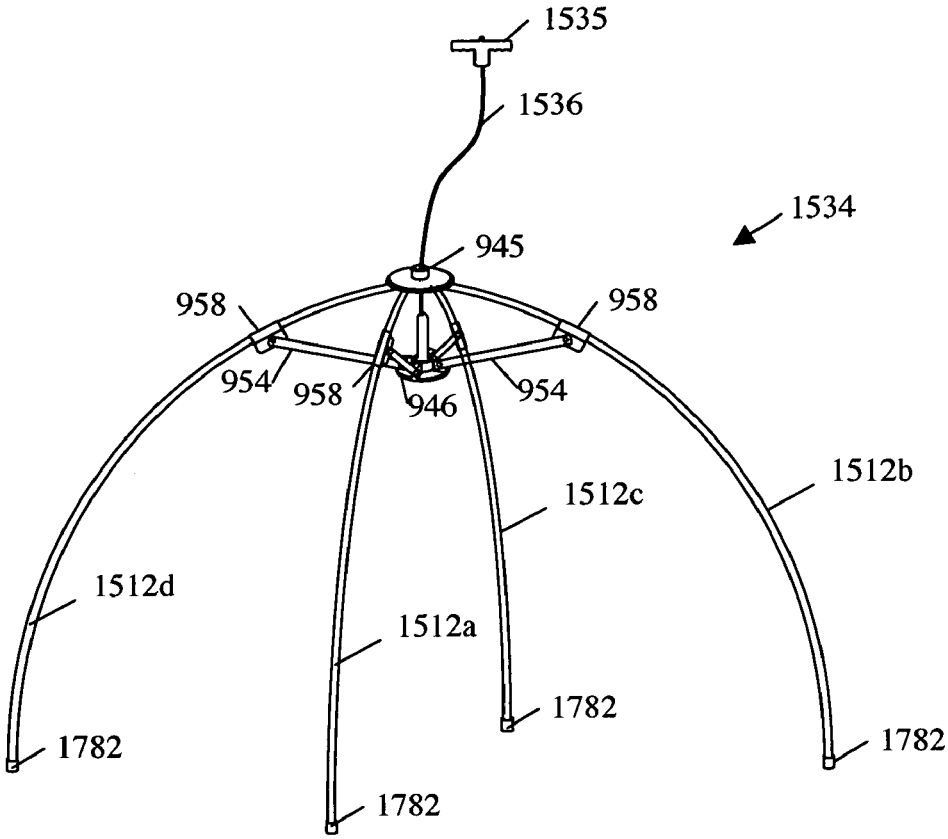
FIG. 2A and FIG. 2B show a fast setup frame for a hunting ground blind.
Figure 2B:
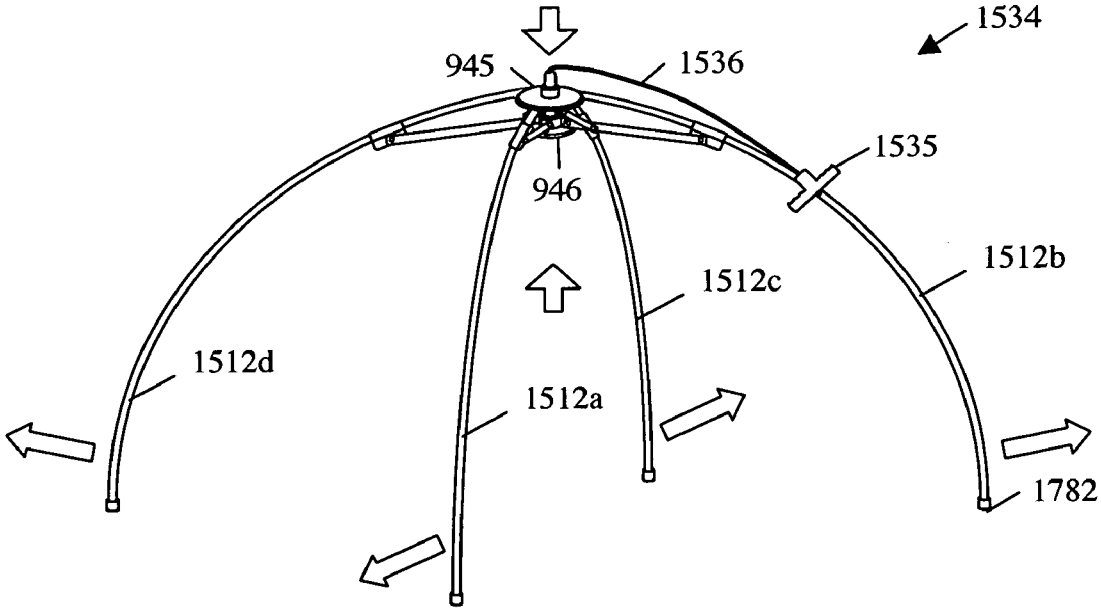

FIG. 2A and FIG. 2B

As discussed above, there is a need for embodiments of hunting ground blinds that can be set up rapidly and standalone in a variety of configurations. FIG. 2A and FIG. 2B show various aspects of an embodiment of a fast setup frame 1534.

FIG. 2A shows a novel fast setup frame 1534. The fast setup frame 1534 comprises a novel upper plate 945 and lower plate 946. The upper plate 945 is connected to half arch cover shafts 1512 (*a-d*). Exemplary details of the upper plate 945 and lower plate 946 interconnections are detailed for various embodiments explained in reference to FIG. 3A and FIG. 3B. Each to half arch cover shaft 15 (*a-d*) is shown connected to respective stretcher shafts 954 (*a-d*) at shaft plates 958 (see FIG. 3A and FIG. 3B for exemplary details). Stretcher shafts 954 (*a-d*) also connect to the novel lower plate 946. An arch flattening means comprising a novel upper plate 945, lower plate 946, stretcher shafts 954 (*a-d*), and a pull cord 1536 for operating the arch flattening means.

Each half arch cover shafts 1512 comprise half an arch. As shown, for example, in FIG. 5B, each half arch cover shaft 1512 could collapse or fold, such as with a hinge. FIG. 2A shows embodiments with four half arch cover shafts identified as 1512*a* through 1512*d*.

The pull cord 1536 preferably is attached at one end to a pull handle 1535.

The free ends of each of the half arch cover shafts 1512 each have an end piece means for attaching the fast setup frame 1534 to a quiet cover 1646 (not shown). The end piece means are shown as end pieces 1782.

FIG. 2B shows that, when the arch flattening means, comprising the lower plate 946 is pulled toward and engaged with the upper plate 945, using the pull cord 1536, the arch is flattened. This arch flattening results on a outward and upward skin tightening force being applied through the half arch cover shafts 1512 along the cover corners, as presented by the force arrows. With the novel features and methods of the present invention as described below, the human operator 400 (see FIG. 5D and FIG. 5E) is able to apply a stronger skin tightening force over a longer working distance than is possible with convention means and methods.

Figure 3A:
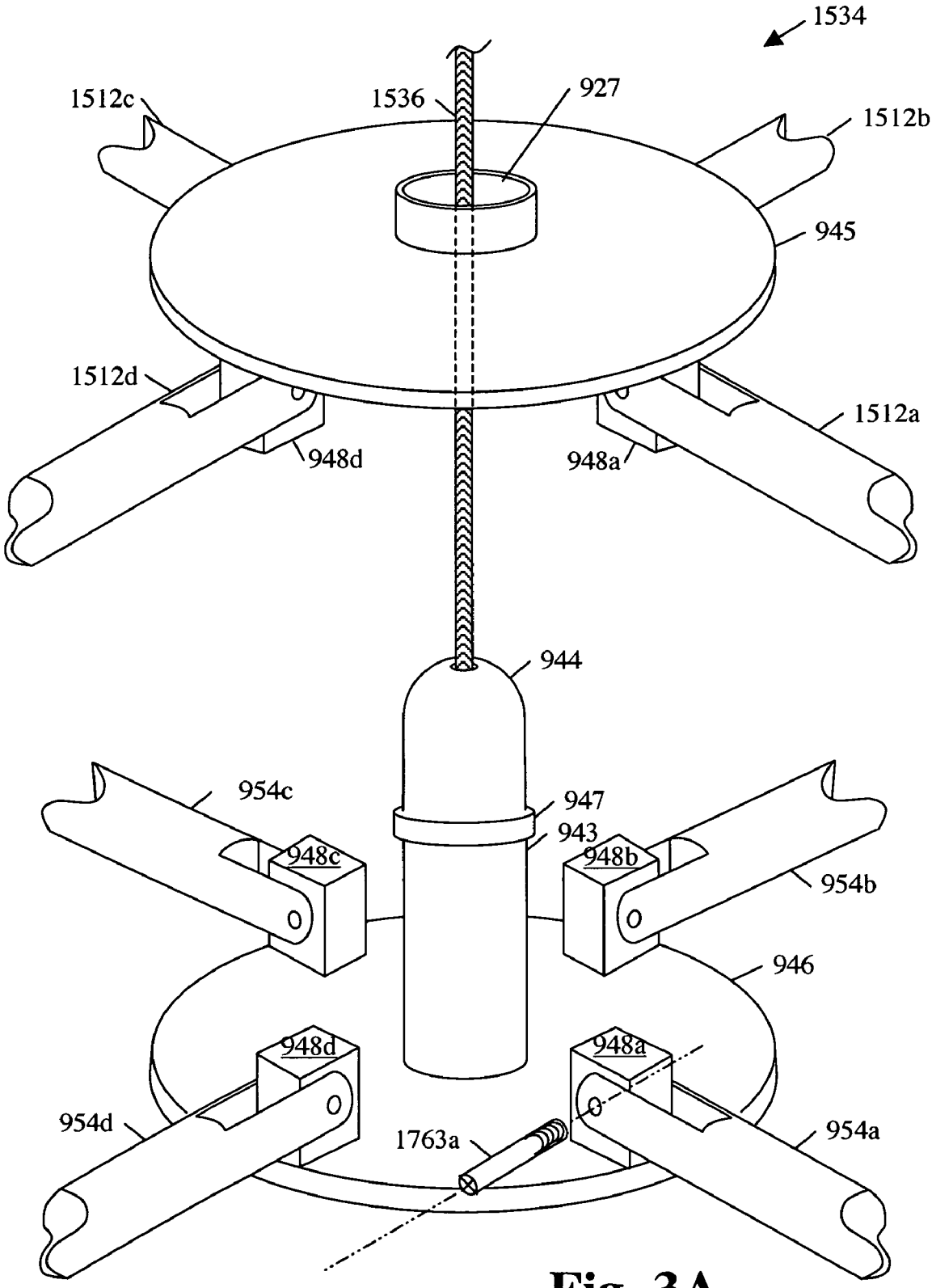
FIG. 3A and FIG. 3B show various details of embodiments of upper and lower plates.
Figure 3B:
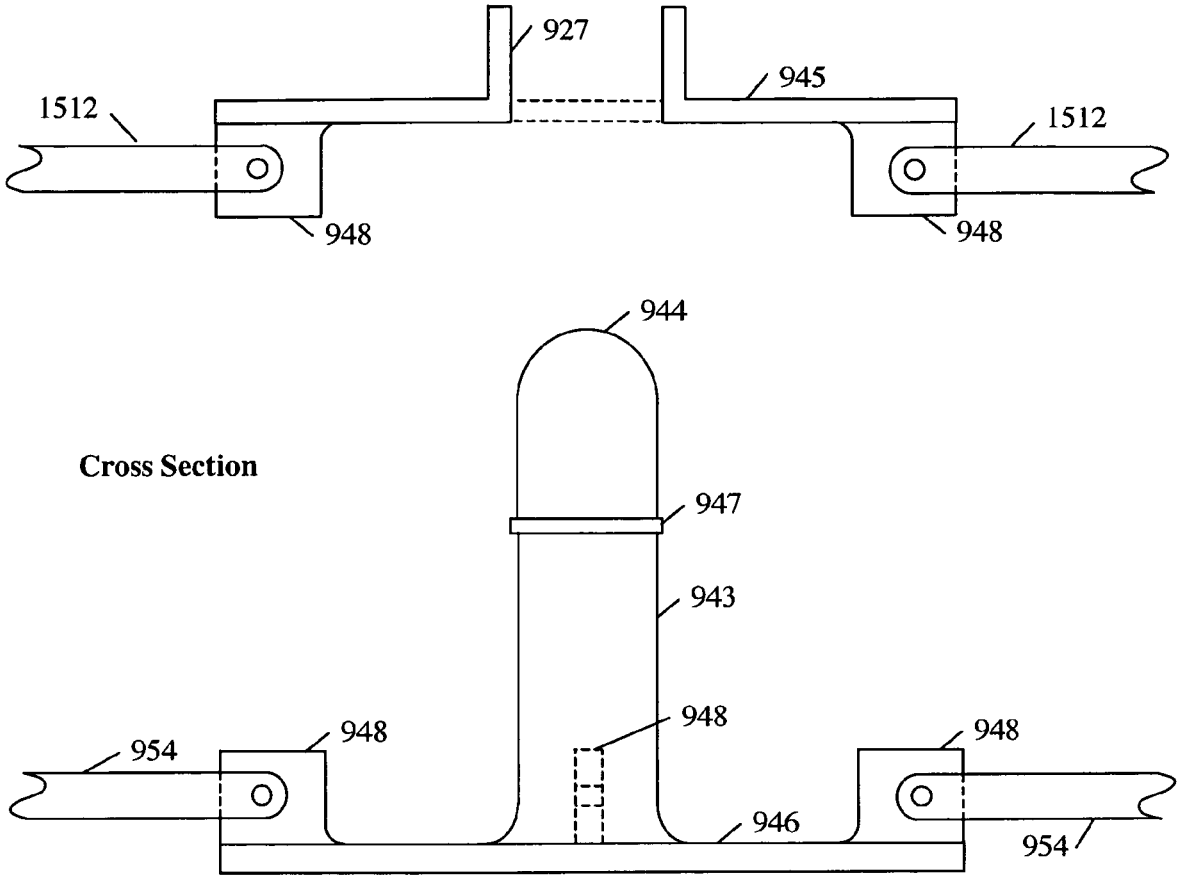

FIG. 3A and FIG. 3B

FIG. 3A is a perspective view of a novel upper plate 945 and lower plate 946 of an embodiment of the fast setup frame 1534. Stretcher shafts 954 (*a-d*) connect to plate anchors 948 (*a-d*) by threaded axles 1763 (*a-d*) respectively on the lower plate 946. Alternatively, the axles could be held in place by and nut or by means other than threads, such having a head on each end.

A separation shaft 943 is connected to the lower plate 946. The half arch cover shafts 1512 (*a-d*) connect to plate anchors 948 (*a-d*) respectively on the upper plate 946. The top portion of upper plate 946 also serves as the foot attaching means 1790. A pull cord 1536 runs through the separation shaft 943 in the lower plate 946 and a plate conduit 927 in the upper plate 945.

By pulling the lower plate 946 toward the upper plate 945 using the pull cord 1536, the separation shaft 943 is guided through the bottom of the upper plate 946 into the plate conduit 927 and inserted up to the point where the separation shaft stop 947 meets the bottom of the upper plate 946. The separation shaft tip 944 is rounded to facilitate entry into the plate conduit 927.

FIG. 3B is a cross sectional view of the of a novel upper plate 945 and lower plate 946 of the embodiment of the fast setup frame 1534 shown in FIG. 3A.

The embodiment of the dockless mechanism in FIG. 3A and FIG. 3B is equally as effective as that one that has a docking mechanism, but requires less material. This improved result is obtained in part by use of stronger and more precise plate anchors 948 (*a-d*) on each plate and the shaft plates 958.

Figure 4A:
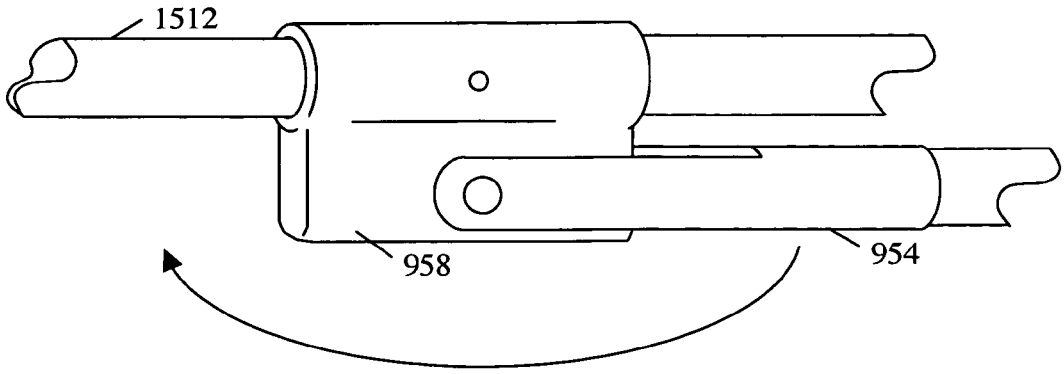
FIG. 4A through FIG. 4C show various details of embodiments of a shaft plate.
Figure 4B:
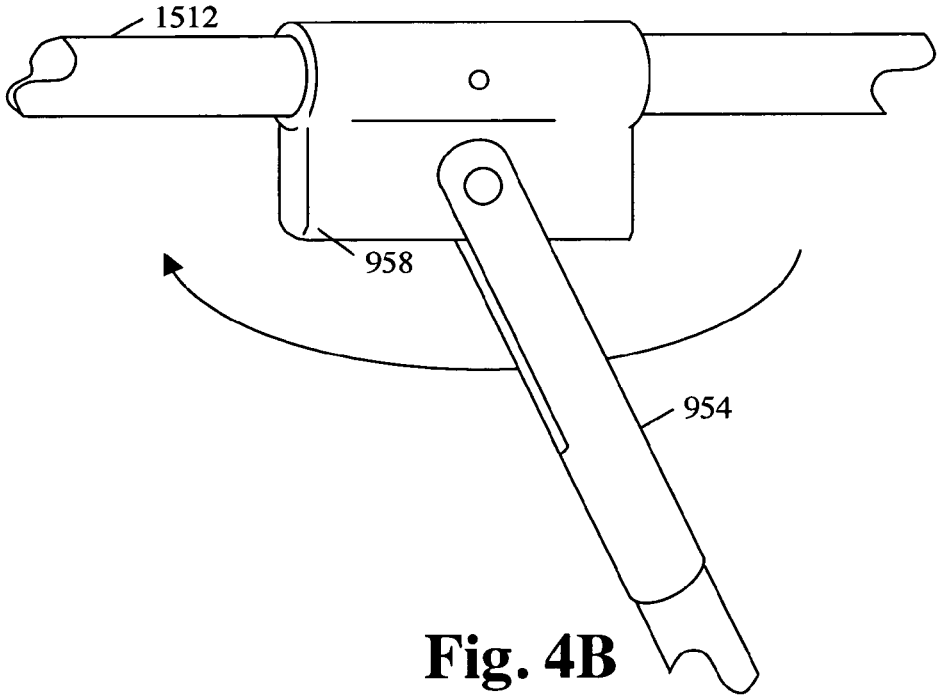
Figure 4C:
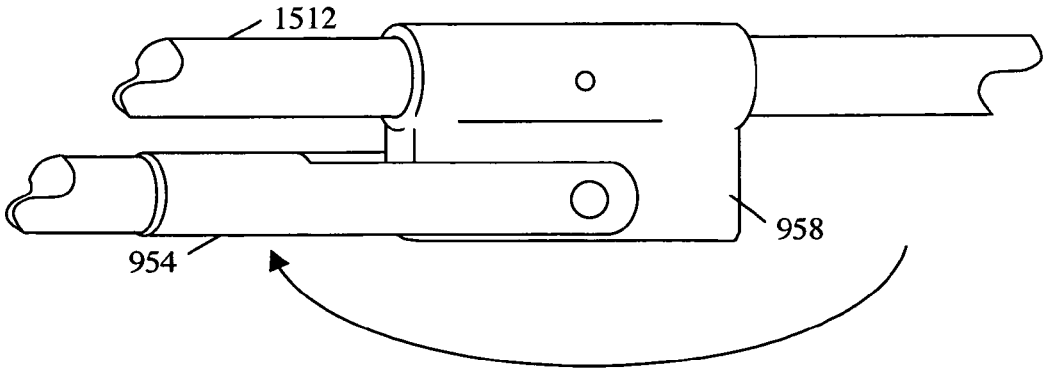

FIG. 4A Through FIG. 4C

FIG. 4A through 4C show details of the shaft plate 958 connection to the stretcher shaft 954. The end of stretcher shaft 954 that interfaces with the shaft plate 958 is preferably flat and tight on either side of the shaft plate 958, such that the stretcher shaft 954 applies an advantageous mechanical force against the shaft plate 958. The stretcher shaft 954 could be composed out of solid, machined or molded, metal shaft or a fiberglass shaft with a metal tip. Each shaft plate 958 is connected to a half arch cover shaft 1512.

FIG. 4A shows the position of the shaft plate 958 and the stretcher shaft 954 when the frame is fully collapsed. FIG. 4B shows the position of the shaft plate 958 and the stretcher shaft 954 when the frame is being set up. FIG. 4C shows the position of the shaft plate 958 and the stretcher shaft 954 when the frame is fully set up.

When the blind is initially being spread, the shaft plate 958 connection provides an advantageous lateral force to cause the fast setup frame 1534 to start to open. The tightness and mechanical area of the connection is especially helpful when the fast setup frame 1534 is in the horizontal position as required by the method shown in FIG. 5C through FIG. 5E. It also increases the durability of the fast setup frame 1534.

The shaft plate 958 and the stretcher shaft 954 connection provides a second advantageous force to the fast setup frame 1534, at point where the separation shaft tip 944 enters the plate conduit 927, to help ensure proper alignment. Further, when the frame is fully set up, it continues to provide stabilizing forces and strength within the fast setup frame 1534 to limit motion and breakage.

FIG. 5A Through FIG. 5H

FIG. 5A through FIG. 5H show novel set up and take down methods of fast setup frame 1534. This sequence is shown using the fast setup frame 1534 as a collapsed bundle having hinged, half arch cover shaft 1512 (*a-d*) folded and then unfolded to full length. The fast setup frame 1534 is covered with the quiet cover 1646 (e.g. FIG. 1A, FIG. 1C, or FIG. 6.), which remains attached to the fast setup frame 1534 when the fast setup frame 1534 is collapsed.

Figure 5A:
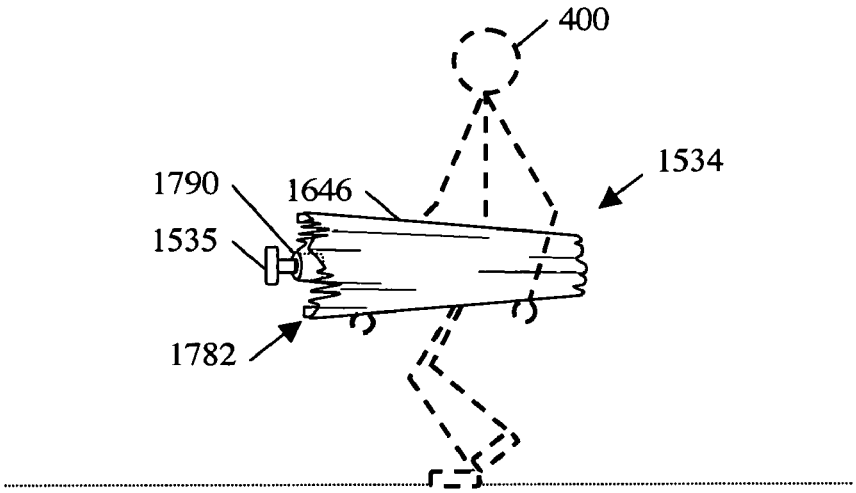
FIG. 5A through FIG. 5H illustrate novel set up and take down methods of the fast setup frame.

FIG. 5A shows the operator 400 carrying the collapsed ground blind using his hands. Next the operator 400 places the collapsed blind on the ground. At this point the fast setup frame 1534 is folded to about half the length of the half arch cover shafts 1512 to collapse into a narrow bundle.

Figure 5B:
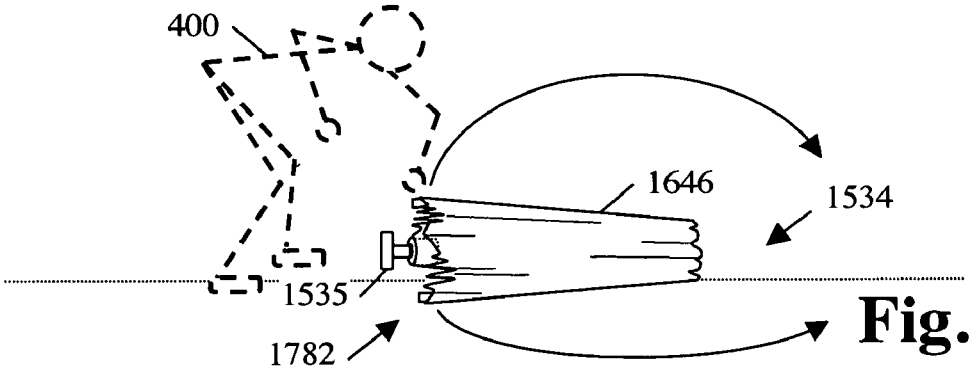
Figure 5C:
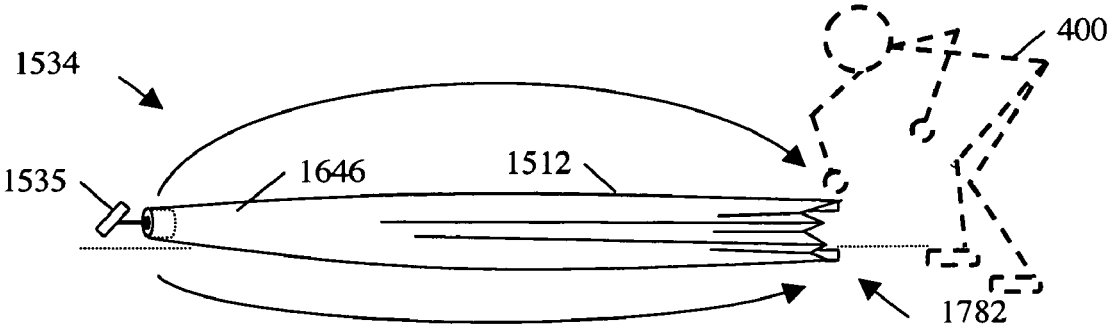

FIG. 5B and FIG. 5C show the operator opening the fast setup frame 1534 by grasping the end piece 1782 of the hinged half arch cover shafts 1512 and rotating the shafts upward, outward and downward until parallel with the ground.

Figure 5D:
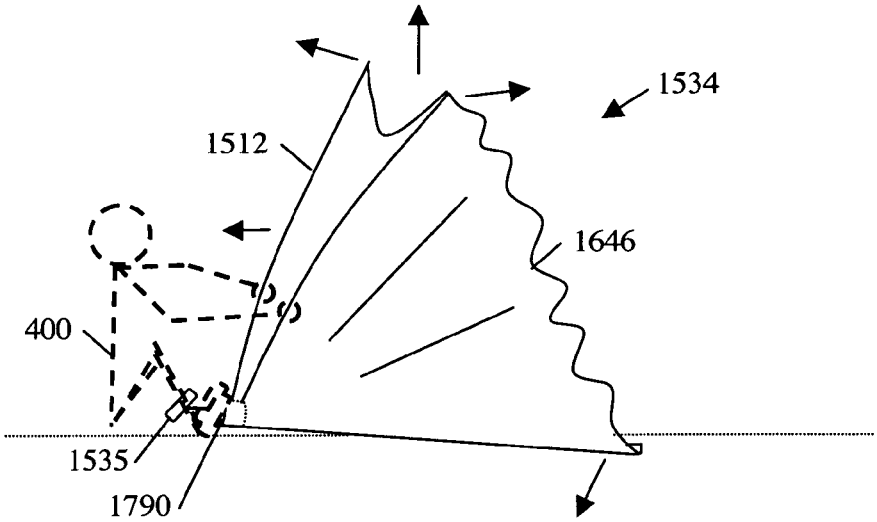

FIG. 5D shows the operator beginning to lean back while holding two of the half arch cover shafts 1512 through the quiet cover 1646 as the fast setup frame 1534 begins to open. It is during this transition from FIG. 5C to FIG. 5D that the first advantages of the flat walls in the various plates connections (e.g. plate anchor 948 (*a-d*) and shaft plate 958) are used. This transition puts a large stress on the fast setup frame 1534 to force it to open. The friction within the plate connections and against the ground starts to hold the blind open. In practice, opening the blind into a light wind makes this step and process easier.

Figure 5E:
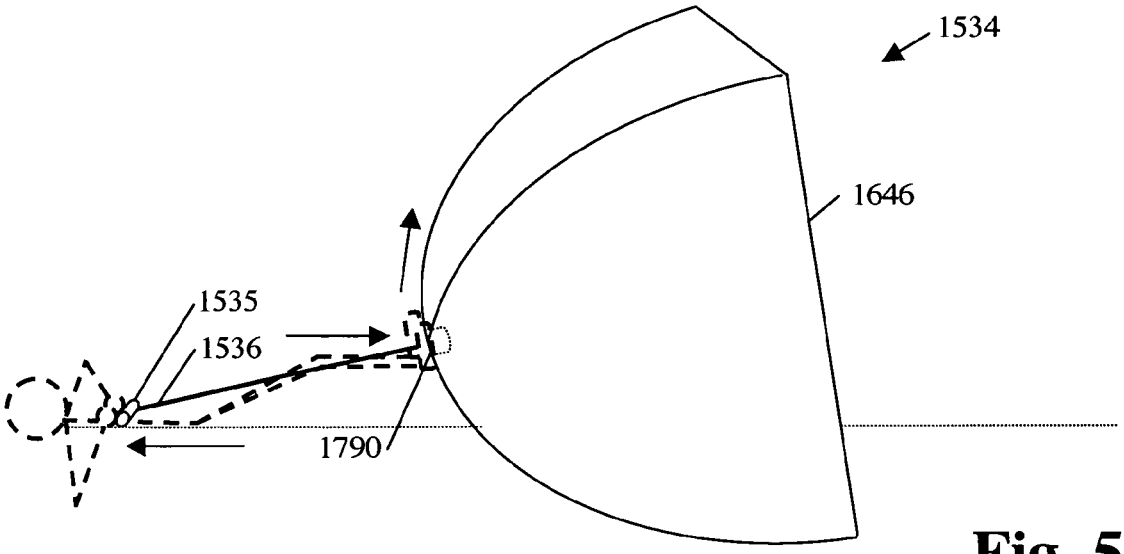

FIG. 5E shows the operator 400 at the end of the seated row stroke. While the operator 400 continues to lean back, the other hand makes a smooth transition to the pull handle 1535. By leaning back, the blind continues to open and the operator 400 lifts the apex of the blind off the ground using the feet. The pull cord 1536 has been moved the full range of motion necessary to engage the upper and lower plates via the separation shaft 943. The operator has released the angular frame 950 and has grasped the pull handle 1535 during the stroke with both hands while continuing to lift the apex of the blind with the foot attaching means 1790. Using this method the operator has been able to apply a cover skin tightening force using a plurality of large muscle groups of the full body from the hands to the feet, whereby the blind is rapidly set up (in only a few seconds). In turn, the quiet cover 1646 stretches over the fast setup frame 1534 with sufficient force that quiet cover 1646 is held taut without substantial movement or noise detectable by wildlife. The force applied by the human body over the range of movement is greater than a force possible with just the arms and shoulders of the conventional methods.

Figure 5F:
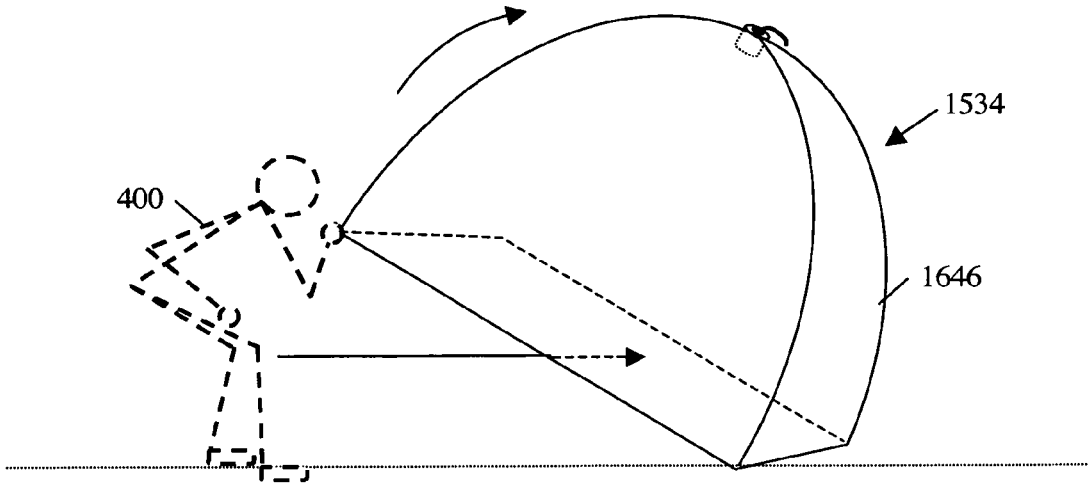

FIG. 5F shows the operator 400 easily lifting the standalone blind and lifting it overhead.

Figure 5G:
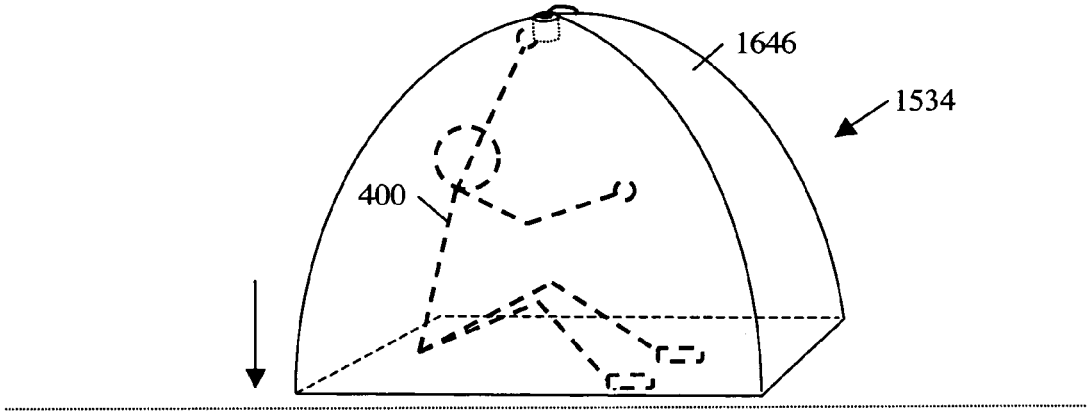

FIG. 5G shows the operator 400 inside the blind. The operator can go from running through the outdoors to being fully concealed (the sequence from FIG. 5A to FIG. 5G) in about seven seconds.

Figure 5H:
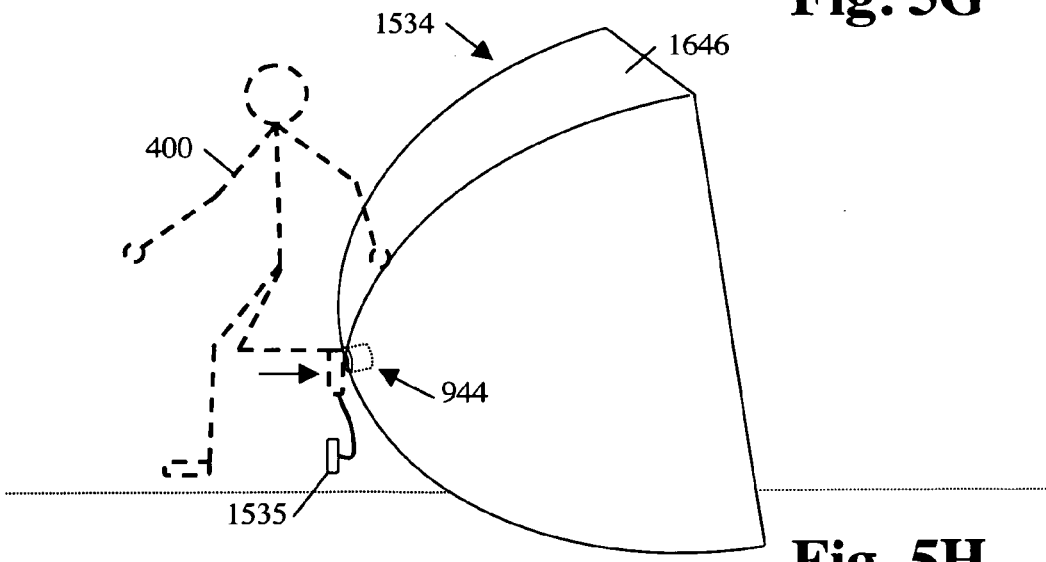

FIG. 5H shows the novel take down method. "You just kick it."™

The operator 400 pulls most of the pull cord 1536 inside the blind, and tips the blind horizontally to slightly below knee level. The operator 400, for example, stands on a dominate right foot, holds the quiet cover 1646 with the left hand, and kicks the separation shaft tip 944 with the left foot. When the stored energy is released, the blind will automatically jump forward under the left arm of the operator 400 where the now collapsed blind also can be grasped in front of the body with the right hand. The operator 400 can immediately move the blind to a new location. The blind can be collapsed in about 3 seconds.

For long-term transportation, the fast setup frame 1534 can be folded to about half the length of the half arch cover shaft 1512 (*a-d*) to collapse into a narrow bundle.

FIG. 6

Figure 6:
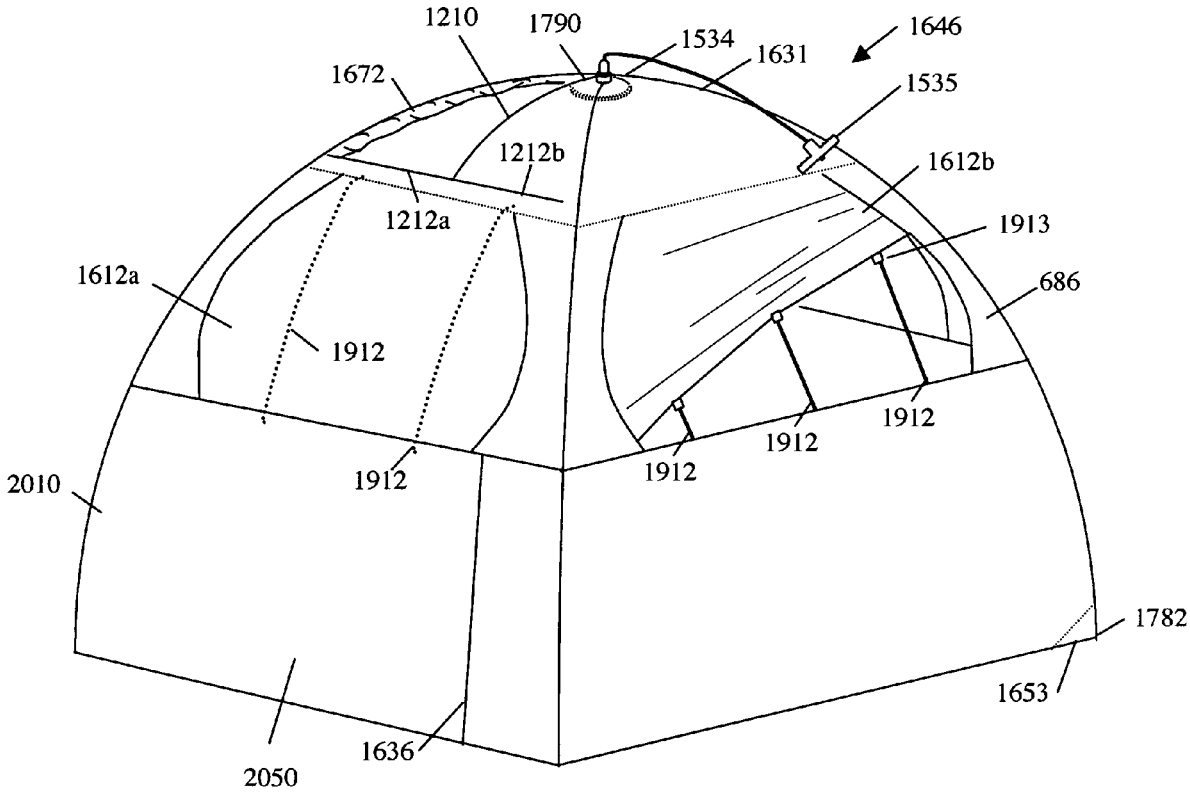
FIG. 6 shows various features of a currently preferred embodiment of a hunting ground blind.

FIG. 6 shows various features of a currently preferred embodiment of a hunting ground blind. The ground blind comprises the fast setup frame 1534 (FIG. 2A) and a three tiered, quiet cover 1646.

The quiet cover 1646 comprises:

cover cap 1631 a corner section 686 in each corner a skirt 2010 corner pockets 1653 for holding the shaft end pieces 1782 two optional inverted-T window, formed by fasteners 1210 and 1212 (*a-b*)

at least two cover windows 1612 (such as 1612*a* and 1612*b*) attached to guylines 1912 with guyline clips 1913 a door fastener 1636, forming a skirt door 2050

The following components of the fast setup frame 1534 (shown in greater detail in FIG. 2A) are visible as illustrated:

a foot attaching means 1790 (e.g. upper plate 945)

pull cord 1536 and pull handle 1535 end pieces 1782

The ground blind is shown with the inverted-T window half open with the open section in a window roll 1672.

In each corner, end piece 1782 is held by a corner pocket 1653. The corner pocket 1653 can be sewn on one or two sides and adjustable with hook and loop fasteners or other fasteners. Alternatively, end pieces 1782 could comprise hooks or slots for attaching to corner loops of cord.

Other cover 1540 embodiments (not shown) could also be used.

FIG. 7

FIG. 7 shows various features of yet another currently preferred embodiment of a hunting ground blind. The ground blind comprises the fast setup frame 1534 (FIG. 2A) and a three tiered, quiet cover 1646.

The quiet cover 1646 comprises:

cover cap 1631 at least two cover windows 1612*b* attached to guylines 1912 with guyline clips 1913 a corner section 686 on either side of each cover window 1612*b* a skirt 2010 on at least two side of the blind corner pockets 1653 for holding the shaft end pieces 1782 an single optional inverted-T window, formed by fasteners 1210 and 1212 (*a-b*)

a door fastener 1636, forming a door and cover window 1612*c*

The following components of the fast setup frame 1534 (shown in greater detail in FIG. 2A) are visible as illustrated:

a foot attaching means 1790 (e.g. upper plate 945)

pull cord 1536 and pull handle 1535 end pieces 1782

The ground blind is shown with the inverted-T window.

In each corner, end piece 1782 is held by a corner pocket 1653.

An embodiment of a see-through panel 1922 is shown as a fixed shoot-through panel 1642 attached inside each wall covering the area shared by each cover window (such as 1612*b*).

If a fourth wall does not have a cover window (such as 1612*b*), some cost could be saved by having no windows or doors, or by having only small windows.

OTHER EMBODIMENTS

The embodiments shown could also be produced in different sizes. Some could be designed to comfortably hold two people with room for video equipment. Other embodiments could be designed for a single person with a lower profile and less windows. Such embodiments would further reduce weight and cost.

Advantages

Inverted-T Window

The inverted-T windows allow the top of the blind to be fully opened, or configured in a waterfowl configuration.

Skin Tightening

The novel means of tightening the skin of the present invention provides methods and means for tightening the skin on the sides of a blind cover to reduce movement and flutter in the wind. The means of the present invention include cover shafts that are stretched to cause a constant outward pressure on the sides of the cover. This is done with lower cost, lighter weight, and easier to use structures.

Simple

The present invention is simple to make and use. Each component is easily made. The present invention requires little time to attach and to set up.

The fast setup frame can be quickly set up to provide rapid concealment.

Easy to Use

The present invention is easy to use.

Lightweight

The present invention comprises a few simple parts that can easily be constructed of lightweight materials. Being lightweight is important for those who have to carry gear into the outdoors.

Compact

The embodiments of the hunting ground blind are compact. When collapsed and folded, the frame and cover are rolled together in relatively small bundles. This is advantageous for both storage and carrying.

Portable

The hunting ground blind is lightweight and compact allowing it to be carried long distances into the outdoors and to be used in a variety of locations.

Quiet

The skin tightening features reduce noise from wind movement or flutter.

The novel use of guylines to secure and move windows eliminate the need for zippers or hook and loop fasteners providing for quiet window or opening operation during wildlife observation.

Lower Cost, Longer Reliability

The present invention provides a number of novel features that reduce the complexity and cost of manufacture and that increase the reliability of the parts.

CONCLUSION, RAMIFICATION, AND SCOPE

Accordingly, the reader will see that the present invention provides an easy to use, simple, lightweight, compact, portable, quiet, fast setup hunting ground blind.

While the above descriptions contain several specifics these should not be construed as limitations on the scope of the invention, but rather as examples of some of the preferred embodiments thereof. Many other variations are possible. The variations could be used without departing from the scope and spirit of the novel features of the present invention.

Accordingly, the scope of the invention should be determined not by the illustrated embodiments, but by the appended claims and their legal equivalents.

We claim:

1. A ground blind, wherein, when set up by a human operator, the ground blind is free standing, the ground blind comprising:

a) a frame comprising:

i) an upper plate, which forms an apex of the ground blind, the ground blind having an axis substantially perpendicular to an upper plate, wherein the upper plate comprises four plate anchors perpendicular to the plane of the upper plate, ii) a lower plate, parallel to the upper plate, wherein the lower plate comprises four plate anchors perpendicular to the plane of the lower plate, iii) four half arch cover shafts each pivotably connected to a respective plate anchor on the upper plate, and each having a shaft plate between the ends thereof, iv) four stretcher shafts pivotably connected to each respective cover shaft plate and pivotably connected to the plate anchors of the lower plate, and v) a separation shaft, connected to the lower plate, and the separation shaft further comprising a separation shaft stop designed to engage the upper plate, vi) a pull cord, connected to the separation shaft, for applying opposing forces to the upper plate and the lower plate to cause the separation shaft to separate the plates at a predetermined distance, vii) a pull handle connected to the other end of the pull cord, b) a cover skin having a predetermined shape, the cover skin comprising:

i) four cover panels, ii) four cover corners formed by cover seams between adjacent cover panels, wherein each of the cover shafts further comprises an end piece connecting each cover shaft to an end of a respective cover corner, wherein each of the cover shafts further comprises a hinge connecting each cover shaft to a lower shaft having a predetermined lower shaft length, wherein the lower shafts are substantially the same length as the respective cover shaft above each respective hinge, wherein, when folded, the collapsed ground blind has an optimum folded length substantially the same as the predetermined lower shaft length, wherein at least two cover panels each comprise a cover window defining a window opening providing an unobstructed shooting area, wherein the cover skin comprises three tiers:

i) a top tier, ii) a middle tier having the at least two cover windows, iii) a bottom tier, wherein the top tier and the bottom tier are independently connected at the cover corners, wherein the top tier and the bottom tier are held taut by a plurality of guylines each connected at each end to the top tier and the bottom tier over the window opening, wherein at least one cover window is connected to at least one guyline with an adjustable guyline clip, whereby the operator configures the window opening by moving the guyline clip along the guyline, wherein at least one cover panel comprises a door fastener forming a door, wherein the ground blind is lightweight, portable, and collapsible, whereby the ground blind is rapidly set up with the operator in a seated row position, whereby the frame stores and transfers the force to the cover shafts, and whereby the cover shafts stretch the cover panels with sufficient force that the skin is held taut without substantial movement or noise.

2. A ground blind, wherein the ground blind is lightweight, portable, and collapsible, and wherein, when set up by a human operator, the ground blind is free standing, the ground blind comprising:

a) a frame comprising:

i) an upper plate, which forms an apex of the ground blind, the ground blind having an axis substantially perpendicular to an upper plate, wherein the upper plate comprises four plate anchors perpendicular to the plane of the upper plate, ii) a lower plate, parallel to the upper plate, wherein the lower plate comprises four plate anchors perpendicular to the plane of the lower plate, iii) four half arch cover shafts each pivotably connected to a respective plate anchor on the upper plate, and each having a shaft plate between the ends thereof, iv) four stretcher shafts pivotably connected to each respective cover shaft plate and pivotably connected to the plate anchors of the lower plate, and v) a separation shaft connected to the lower plate and designed to engage the upper plate, vi) a means for applying opposing forces to the upper plate and the lower plate to cause the separation shaft to separate the plates at a predetermined distance, b) a cover skin having a predetermined shape, the cover skin comprising:

i) four cover panels, ii) four cover corners formed by cover seams between adjacent cover panels, wherein the cover comprises three tiers, a middle tier having a plurality of cover windows, each cover window defining a window opening, wherein a top tier and a bottom tier are held taut by a plurality of corner sections each connected at each end to the top tier and the bottom tier.

3. The ground blind of claim 2, wherein the means for applying opposing forces comprises a pull cord connected to the separation shaft and to a pull handle.

4. The ground blind of claim 2, wherein each of the cover shafts further comprises a hinge connecting each cover shaft to a lower shaft having a predetermined lower shaft length.

5. The ground blind of claim 4, wherein the lower shafts are substantially the same length as the respective cover shaft above each respective hinge, whereby when folded the collapsed ground blind has an optimum folded length substantially the same as the predetermined lower shaft length.

6. The ground blind of claim 4, wherein the predetermined lower shaft length is substantially about two feet, providing ground blind for one operator.

7. The ground blind of claim 4, wherein at least two of the lower shafts capable of being folded up to allow the ground blind axis to be placed at an angle less than 90 degrees relative to the ground.

8. The ground blind of claim 2, wherein the cover comprises an inverted-T window.

9. The ground blind of claim 2, wherein at least two window openings each provide an unobstructed shooting area.

10. The ground blind of claim 2, wherein at least one window opening is covered with a see-through panel.

11. The ground blind of claim 10, wherein the see-through panel is removably attached to at least two sides of the window opening, forming a fixed shoot-through panel.

12. The ground blind of claim 2, wherein a top tier and a bottom tier are held taut by a plurality of guylines each connected at each end to the top tier and the bottom tier over at least one window opening.

13. The ground blind of claim 2, wherein the separation shaft further comprises a separation shaft stop designed to engage the upper plate.

14. The ground blind of claim 2, wherein the means for applying the force is a pull cord, whereby the ground blind is set up with the operator in a seated row position, whereby the frame stores and transfers the force to the cover shafts, and whereby the cover shafts stretch the cover panels with sufficient force that the skin is held taut without substantial movement or noise.

15. A ground blind, wherein the ground blind is lightweight, portable, and collapsible, and wherein, when set up by a human operator, the ground blind is free standing, the ground blind comprising:

a) a frame comprising:

i) an upper plate, which forms an apex of the ground blind, the ground blind having an axis substantially perpendicular to an upper plate, wherein the upper plate comprises four plate anchors perpendicular to the plane of the upper plate, ii) a lower plate, parallel to the upper plate, wherein the lower plate comprises four plate anchors perpendicular to the plane of the lower plate, iii) four half arch cover shafts each pivotably connected to a respective plate anchor on the upper plate, and each having a shaft plate between the ends thereof, iv) four stretcher shafts pivotably connected to each respective cover shaft plate and pivotably connected to the plate anchors of the lower plate, and v) a separation shaft connected to the lower plate and designed to engage the upper plate, vi) a means for applying opposing forces to the upper plate and the lower plate to cause the separation shaft to separate the plates at a predetermined distance, b) a cover skin having a predetermined shape, the cover skin comprising:

i) four cover panels, ii) four cover corners formed by cover seams between adjacent cover panels, wherein the cover comprises three tiers, a middle tier having a plurality of cover windows, each cover window defining a window opening wherein a top tier and a bottom tier are held taut by a plurality of guylines each connected at each end to the top tier and the bottom tier over at least one window opening, wherein at least one cover window is connected to at least one guyline with an adjustable guyline clip, whereby the operator configures the window opening by moving the guyline clip along the guyline.

16. The ground blind of claim 15, wherein each of the cover shafts further comprises a hinge connecting each cover shaft to a lower shaft having a predetermined lower shaft length.

17. The ground blind of claim 16, wherein at least two of the lower shafts capable of being folded up to allow the ground blind axis to be placed at an angle less than 90 degrees relative to the ground.

18. The ground blind of claim 15, wherein the cover comprises an inverted-T window.

19. The ground blind of claim 15, wherein at least two window openings provide an unobstructed shooting area.

20. The ground blind of claim 15, wherein at least one window opening is covered with a see-through panel removably attached to at least two sides of the window opening, forming a fixed shoot-through panel.

* * * * *